United States Patent [19]

Davis et al.

[11] Patent Number: 4,895,249

[45] Date of Patent: Jan. 23, 1990

[54] SYSTEM AND METHOD FOR PACKAGING DETONATING CORD FOR TRANSPORT

[75] Inventors: Billy F. Davis, Houston; Michael P. Hancock, Cleburne; Scott L. Hayes, Mansfield, all of Tex.

[73] Assignee: Pengo Industries, Inc., Fort Worth, Tex.

[21] Appl. No.: 110,227

[22] Filed: Oct. 19, 1987

[51] Int. Cl.[4] ..... B65D 81/02

[52] U.S. Cl. ..... 206/3; 206/495; 206/334; 206/585; 206/593

[58] Field of Search ..... 206/3, 63.3, 303, 328, 206/334, 495, 521, 585, 593; 86/1.1, 50; 102/275.1

[56] References Cited

U.S. PATENT DOCUMENTS

| | | | |
|---|---|---|---|
| 2,895,210 | 7/1959 | Hubbard | 206/63.3 |
| 2,943,732 | 7/1960 | Kovaleski et al. | 206/303 |
| 3,780,854 | 12/1973 | Ruppenthal | 206/495 |
| 4,582,196 | 4/1986 | Hughson et al. | 206/63.3 |
| 4,586,602 | 5/1986 | Levey | 206/3 |
| 4,699,271 | 10/1987 | Lincoln et al. | 206/63.3 |

*Primary Examiner*—David T. Fidei
*Attorney, Agent, or Firm*—Arthur F. Zobal

[57] ABSTRACT

A detonating cord transport system is disclosed wherein detonating cord is windingly disposed on a plurality of separator-support members in such a manner that the cord is wholly accessible from a front face surface and is thus disposed without having to manipulate the separator-support members. For each separator-support member, the detonating cord is windingly disposed on a plurality of winding support devices such that there are a plurality of severing locations at frequent intervals at which severing locations there is incorporated means for stopping any detonation that occurs, with the result that such detonation will be confined to a relatively short length of detonating cord and will also be confined to the detonating cord transport system container.

25 Claims, 3 Drawing Sheets

Fig. 1
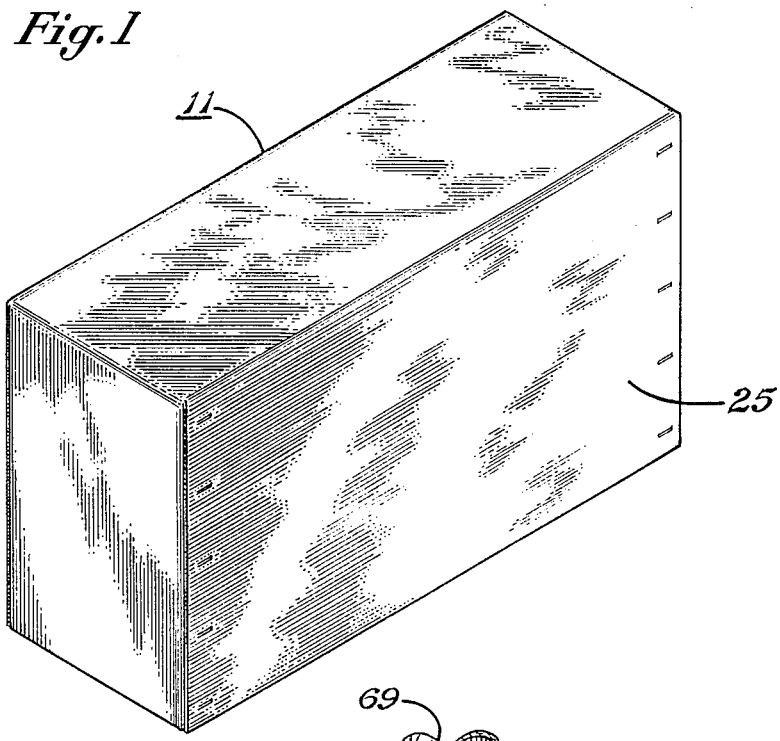
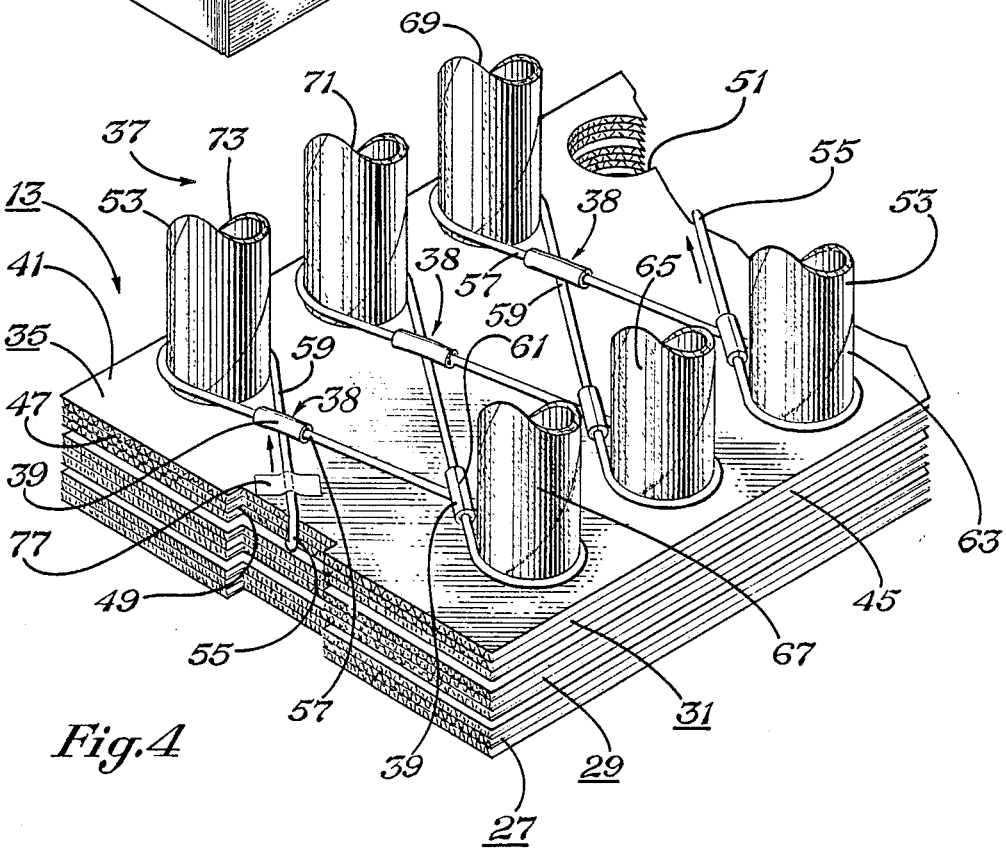
Fig. 4

SYSTEM AND METHOD FOR PACKAGING DETONATING CORD FOR TRANSPORT

FIELD OF THE INVENTION

The invention relates to the transporting of detonating cord and more particularly to systems and methods for use in the packaging of detonating cord for transport.

BACKGROUND OF THE INVENTION

Detonating cord is used extensively in the petroleum exploration and production industry to initiate the detonation of explosive materials in various types of downhole tools, such as perforating tools, setting tools, and the like. The borehole sites at which such tools and associated detonating cord are used are scattered worldwide, as are the relevant manufacturing, supply and service facilities. Consequently it is highly desirable that such tools, as well as the associated detonating cord be shipped by air from the supply facility location to the location of the using facility. However, the regulations governing the shipment of explosive materials by air are quite stringent. Basically, the regulations require that the explosive materials be packaged such that any ignition or detonation shall be confined to that container and will not propogate to another container.

U.S. Pat. No. 4,586,602, which is assigned to the assignees of the present invention, discloses a detonating cord transport system that meets the above mentioned air shipping regulations for explosive materials. The detonating cord transport system of the '602 patent is, however, susceptible to some improvements that will serve to increase economy and efficiency, particularly regarding the amount of labor required in packaging detonating cord and the quantity of detonating cord per package.

It is the objective of the present invention to provide improved systems and methods for packaging detonating cord in containers in such manner as to qualify for shipment by commercial air carriers in the United States of America and internationally.

BRIEF DESCRIPTION OF THE DRAWINGS

FIG. 1 is an isometric view of an assembled detonating cord transport system of the present invention, in accordance with a preferred embodiment.

FIG. 4 is a fragmentary isometric view showing steps in the winding of detonating cord on a section that are subsequent to the steps shown in FIG. 3.

DESCRIPTION OF PREFERRED EMBODIMENTS

A detonating cord transport system 11 in accordance with a preferred embodiment of the present invention is shown in FIGS. 1–4 of the drawings. The detonating cord transport system 11 includes a detonating cord transport package 13 which is surrounded by top, bottom, side and end baffle members 15, 17, 19, 21 respectively, and placed in a telescoping type container having inner and outer parts 23, 25.

Figure 3:
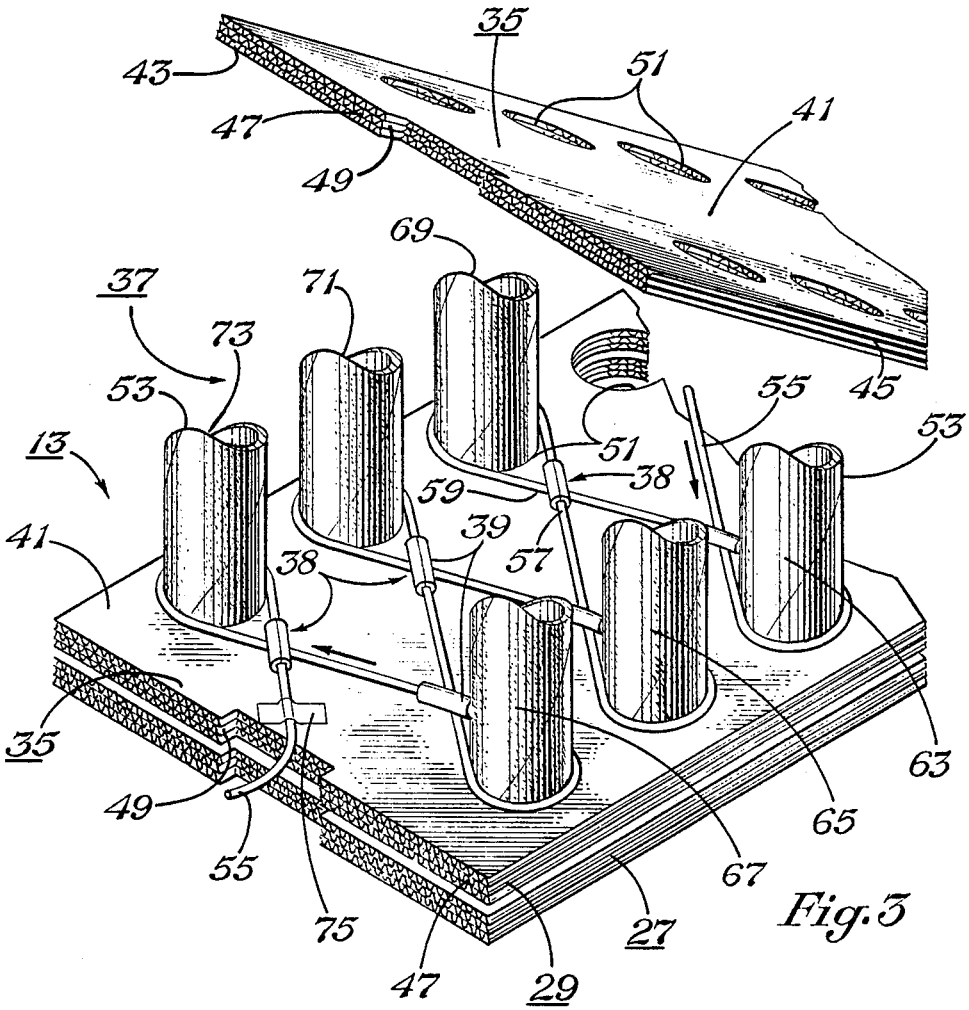
FIG. 3 is a fragmentary isometric view showing steps in the winding of detonating cord on a section.

The detonating cord transport package 13 is made up of a plurality of sections 27, 29, 31, 33. As shown in FIGS. 3 and 4, each transport package section includes a separator-support member 35, winding support means 37, and severing means 39. Each separator-support member 35 has a front face surface 41, a back face surface 43, side edge surfaces 45 and end edge surfaces 47. Opposite end edge surfaces are provided with end edge notches 49 which are centered on the end edge surfaces 47. Each separator-support member 35 has a plurality of circular openings 51 that extend therethrough and communicate between the front and back face surfaces 41, 43. The circular openings 51 are arranged in two rows near the respective side edge surfaces 45. The respective openings 51 are positioned in the same relative positions on each separator-support member 35 so that when the separator-support members are stacked (as will be explained in more detail hereinafter), the respective openings of each separator-support member are aligned with the respective openings of the other separator-support members thereby forming channels through the stack of separator-support members.

The winding support means 37 includes a plurality of columnar winding support members 53. Each winding support member 53 is a cylindrical tube that can be received by any of the openings 51 on a separator-support member 35, and therefore can extend through any one of the channels formed by the openings 51 in a stack of separator-support members 35. Each section thus includes a portion of the length of each winding support member 53 that projects from the separator-support member front face surface 41. The openings 51 and the winding support members 53 are sized to provide a mating fit so as to preclude the spread of a detonation from one section to other sections. The cylindrical winding support members are of substantially the same length.

As shown in FIGS. 3 and 4, a continuous length of the detonating cord 55 to be packaged is windingly disposed on the winding support members 53, traversing portions of the respective separator-support member front face surface 41 such that there are a plurality of severing locations 38 on the front face surface 41. At each severing location 38, a first detonating cord portion 57 is disposed in proximity with a second detonating cord portion 59, and a portion of the severing means 39 is interposed between the first and second detonating cord portions. The severing means 39 as shown in a piece of nylon reinforced rubber hose which has a longitudinal slit 61 for installation onto a portion of the detonating cord 55 and which is sometimes hereinafter referred to as severing means hose 39.

A preferred method of packaging detonating cord in accordance with the present invention will now be described with reference to FIGS. 3 and 4. In describing the method of packaging detonating cord, it will be convenient to refer to first, second and third "near" winding support members 63, 65, 67 and to first, second and third "far" winding support members 69, 71, 73 with reference to the orientations of FIGS. 3 and 4 on the drawing sheets. Referring particularly now to FIG. 3, the section 29 is completed by winding the detonating cord 55 on the first near winding support member 63 in a counterclockwise direction, and then over the detonating cord at a first severing location where a severing means hose 39 is interposed between the two detonating cord portions by opening its longitudinal slit 61 wide enough to allow the insertion of the respective detonating cord portion through the slit and into the hose, and onto the first far winding support member 69 on which the detonating cord is wound in a clockwise direction, and then over the detonating cord at a second severing location where a piece of severing means hose 39 is installed and onto the second near winding support member 65 on which the detonating cord is wound in a counterclockwise direction, and then over the detonating cord at a third severing location where a piece of severing means hose is installed and onto the second far winding support member 71 on which the detonating cord is wound in a clockwise direction, and then over the detonating cord at a fourth severing location where a piece of severing means hose is installed and onto the third near winding support member 67 on which the detonating cord is wound in a counterclockwise direction, and then over the detonating cord at a fifth severing location where a piece of severing means hose is installed and onto the third far winding support member 73 on which the detonating cord is wound in a clockwise direction, and then over the detonating cord at a sixth severing location where a piece of severing means hose is installed and onto the respective end edge notch 49 where the detonating cord is secured to the front face surface of the separator-support member 35 by a piece of tape 75, thus completing the section 29. The next separator-support member 35 is positioed over the winding support members 53 such that the separator-support member circular openings 51 are aligned with the winding support members. The separator-support member 35 is then pushed down along the lengths of the winding support members until the back face surface 43 of the separator-support member abuts the severing means hoses 39. Referring to FIG. 4, the next section 31 is begun by bringing the detonating cord 55 up through the adjacent end edge notch 49 of the uppermost separator-support member 35 and on to the front face surface 41 where the detonating cord is secured by a piece of tape 77. The detonating cord is wound onto the third far winding support member 73 in a counterclockwise direction and then over the detonating cord at a first severing location where a piece of severing means hose 39 is installed and onto the third near winding support member 67 on which the detonating cord is wound in a clockwise direction, and then over the detonating cord at a second severing location where a piece of severing means hose 39 is installed and onto the second far winding support member 71 on which the detonating cord is wound in a counterclockwise direction, and over the detonating cord at a third severing location where a piece of severing means hose is installed and onto the second near winding support member 65 on which the detonating cord is wound in a clockwise direction, and then over the detonating cord at a fourth severing location where a piece of severing means hose is installed and onto the first far winding support member 69 on which the detonating cord is wound in a counterclockwise direction, and then over the detonating cord at a fifth severing location where a piece of severing hose is installed and onto the first near winding support member 63 on which the detonating cord is wound in a clockwise direction, and then over the detonating cord at a sixth severing location where a piece of severing means hose is installed and so on until the respective end edge notch of the separator-support member is reached, thereby completing the section 31.

The detonating cord transport package 13 is begun by initially winding the detonating cord 55 on those portions of the winding support members that are associated with the bottommost section 27. The steps for winding detonating cord on the section 31 as described above with reference to FIG. 4 are followed in winding the detonating cord on the bottommost section 27, but with the following exception: Instead of bringing the detonating cord up through an end edge notch, the starting end portion of the detonating cord is taped in position near the respective end edge notch on the front face surface of the bottommost separator-support member 35.

Additional separator-support members 35 can be added in stacked sequence and the above steps repeated to create new sections. The number of sections which make up a package 11 is determined by the length of detonating cord that can be wound on a section and by the total length of detonating cord that is desired in that package.

The severing means hoses 39 are positioned at the severing locations such that each hose encompasses one of the detonating cord portions and extends beyond the side of the other of the detonating cord portions. Thus, for example, in FIG. 4, the severing means hose 39 at the first severing location encompasses the first detonating cord portion 57 and extends beyond the sides of the second detonating cord portion 59.

When the uppermost section has been finished, the detonating cord package 11 is completed by binding the sections together with strapping tape (not shown). The package 11 is then placed on top of the bottom baffle member 17 and inside of the telescoping container inner part 23 (see FIG. 2). Side and end baffle members 19, 21 are inserted around the detonating cord transport package 11 and the top baffle member 15 is placed on top of the package. The telescoping container outer part 25 is then placed over the inner part 23. The result is the detonating cord transport system 11 of FIG. 1.

Figure 5:
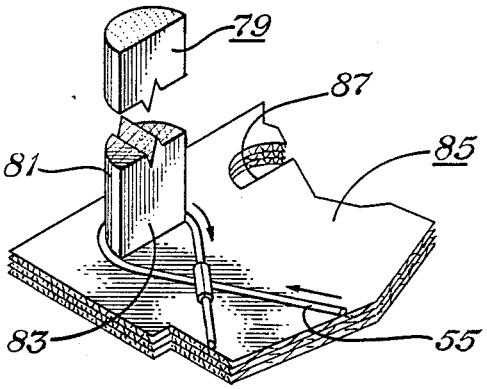
FIG. 5 is a fragmentary isometric view showing a winding support member in accordance with another embodiment of the invention.

Details of a winding support member 79 in accordance with another embodiment of the invention are shown in FIG. 5. The winding support member 79 of FIG. 5 is also columnar but is semi-cylindrical in shape. The winding support member 79 is oriented such that the detonating cord is wound on the curved portion 81 of the winding support member instead of on the flat portion 83. This orientation prevents damage to the detonating cord 55 by eliminating sharp corners over which the detonating cord must be wound. The separator-support member 85 has semi-circular openings 87 cut to matingly receive the semi-cylindrical winding support member 79.

Figure 6:
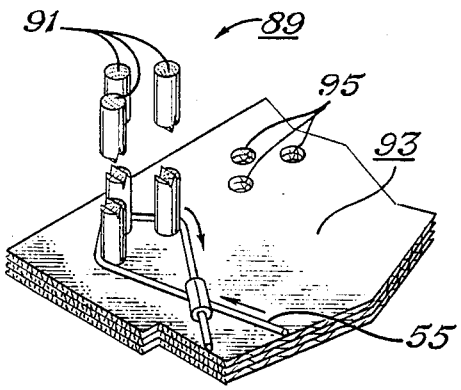
FIG. 6 is a fragmentary isometric view showing a winding support arrangement in accordance with a further embodiment of the invention.

In FIG. 6, there are shown details of a winding support means in accordance with another embodiment of the invention. In this embodiment, the winding support means includes a plurality of columnar winding support arrangements 89. Each winding support arrangement 89 includes a plurality of columnar members 91 of smaller diameter than the winding support members 53. The separator-support member 93 has a separate opening 95 for each columnar member 91. The columnar members are oriented such that the detonating cord 55 bears on all three columnar members 91. The columnar members 91 are preferably wooden dowels, but they may be rods or tubes of other suitable materials such as cardboard or plastic.

Figure 2:
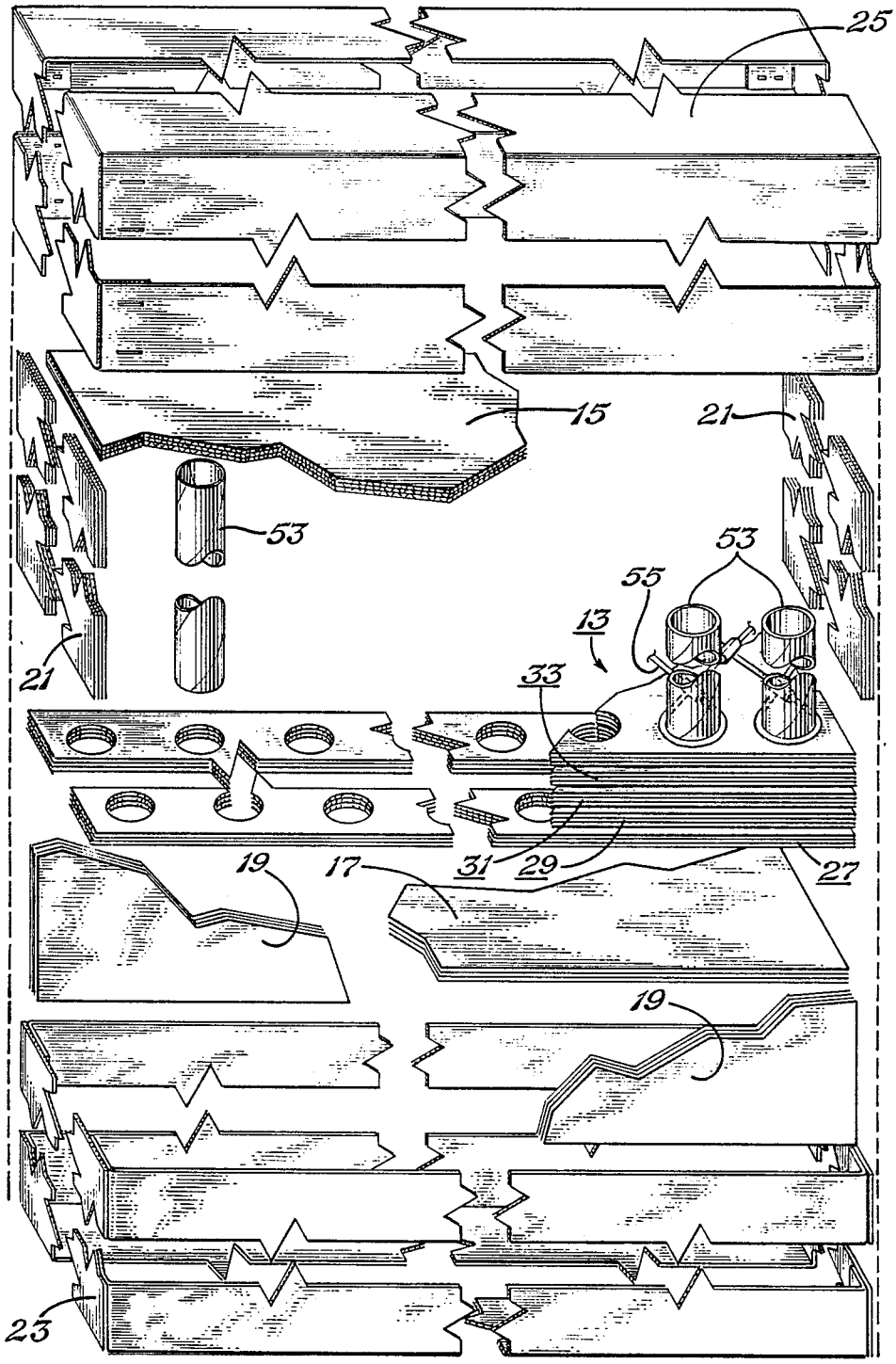
FIG. 2 is a fragmentary exploded isometric view showing portions of the detonating cord transport system of FIG. 1.

The purpose of the detonating cord transport package of the present invention is to accomplish the objective that any ignition or detonation of the detonating cord that is initiated anywhere within the detonating transport package (when the package is installed in the container as described herein with reference to FIGS. 1 and 2) shall be confined within the detonating cord transport package container and will not propagate to another container. The operation of the detonating cord transport package of the present invention is that a detonation of the detonating cord initiated at any location on or within the detonating cord transport package will of course travel in opposite directions from the ignition point, but will be stopped by the first severing location encountered in both directions.

In the embodiment shown by FIGS. 2 through 4, the separator-support members may be typically of such size (about 43 inches in length and 14 inches in width) as to accommodate about 25 feet of detonating cord. The detonating cord is typically packaged in 20 layers or sections so that 500 feet of detonating cord can be shipped in one container. Such a 20 section package is about 24 inches in height. With the illustrated arrangement the maximum length of detonating cord that would be detonated as a result of an ignition would be about one foot for a transport package section. This would occur when the ignition point is on a loop of detonating cord extending from a severing location to a winding support member and back to the severing location, with each such loop being about one foot in length. The total detonation that can occur as a result of an ignition in the detonating transport package of the present invention is insufficient to result in propagation from one container to another.

An important aspect of the present invention is the increased economy and efficiency with which detonating cord can be packaged for shipment. The continuous length of detonating cord that is disposed on a separator-support member must have numerous changes of direction so that the cord can pass in proximity to itself at the severing locations. These changes in the direction of the detonating cord are achieved by disposing the cord on the separator-support member so as to have a winding path. The winding support means, which is wholly accessible from the front face surface of the separator-support member, allows the winding disposition of detonating cord on the separator-support member such that the cord is disposed without having to manipulate the separator-support member, thus resulting in a reduction of labor. The amount of labor required in packaging detonating cord is further reduced by the ease of installation of the severing means onto the detonating cord at each severing location. Due to the increased efficiency in packaging detonating cord, increased quantities of detonating cord can be economically packaged.

The winding support means need not extend through the separator-support members and need not be columnar. Each separator-support member may have a dedicated winding support means that does not extend to the adjacent separator-support members.

The winding support members can have shapes other than the cylindrical or semi-cylindrical shapes described herein so long as the detonating cord which is wound on the winding support members is provided with sufficient turning radius (about a one-half inch minimum) in order to prevent damage to the detonating cord. It has been found in practice that a satisfactory size for a cylindrical winding support member is $2\frac{1}{2}$ inches in diameter. Similarly, the columnar members of a winding support arrangement can have shapes other than the cylindrical shape described herein and can be arranged in other configurations so long as the detonating cord is wound with an acceptable turning radius as discussed above. The columnar members 91 shown in FIG. 6 may typically have a $\frac{3}{8}$ inch diameter.

The severing means can utilize forms and materials other than the nylon reinforced hose pieces shown and described. For example, the hose piece need not entirely encompass the detonating cord. Also, any material that will effectively accomplish the requisite severing action may be used, and it may take any form that can be conveniently installed.

The manner of winding detonating cord and the disposition of the winding support members may vary from that shown and thus far described so long as the requisite severing locations are provided. For example, the detonating cord may be wound such that is progresses back and forth from near row to far row to near row, etc., with no crossovers. With such an arrangement suitable means would be provided to cause the detonator cord to pass in close lateral proximity with itself at severing locations located between the near and far rows of winding support members. Severing means would be installed between the two portions of detonating cord at each severing location.

It has been found in practice that the separator-support members can be layers of cardboard. In the embodiments shown, three layers of about one-fourth inch thick corrugated cardboard are used. It has also been found in practice that the winding support members 53 can be cardboard tubes. Other materials capable of performing the requisite functions could also be used in the separator-support members and in the winding support members.

The foregoing disclosure and the showings made in the drawings are merely illustrative of the principles of this invention and are not to be interpreted in a limiting sense.

We claim:

1. A detonating cord transport package comprising a plurality of stacked sections, with each section comprising:

a. a detonating cord separator-support member having front and back face surfaces and edge surfaces;

b. detonating cord winding support means disposed interiorly of said edge surfaces of said separator-support member and projecting from said separator-support member front face surface;

c. a continuous length of detonating cord windingly disposed on said winding support means and traversing portions of said separator-support member front face surface such that there are a plurality of severing locations where a second detonating cord portion is disposed in proximity with a first detonating cord portion; and d. severing means interposed between said first and second detonating cord portions at each of said severing locations.

2. The detonating cord transport package of claim 1 wherein:

a. said separator-support members each have a plurality of openings extending therethrough and communicating between said front and back face surfaces;

b. said winding support means comprises a plurality of columnar winding support members that extend through said openings in said separator-support members, wherein each section comprises portions of said columnar winding support members.

3. The detonating cord transport package of claim 2 wherein said columnar winding support members are cylindrical.

4. The detonating cord transport package of claim 2 wherein each of said columnar winding support members is a single cylindrical tube.

5. The detonating cord transport package of claim 2 wherein said columnar winding support members are semi-cylindrical.

6. The detonating cord transport package of claim 1 wherein:

a. said separator-support members each have a plurality of openings extending therethrough and communicating between said front and back face surfaces, b. said winding support means comprises a plurality of columnar winding support arrangements, wherein each of said winding support arrangements comprises a plurality of columnar members that extend through said openings in said separator-support members, and wherein each section comprises portions of said columnar members.

7. The detonating cord trasnport package of claim 1 wherein said severing means comprises a portion of a nylon reinforced rubber hose that at least partially encompasses one of said detonating cord portions.

8. The detonating cord transport package of claim 2 wherein said severing means comprises a portion of a nylon reinforced rubber hose that at least partially encompasses one of said detonating cord portions.

9. The detonating cord transport package of claim 3 wherein said severing means comprises a portion of a nylon reinforced rubber hose that at least partially encompasses one of said detonating cord portions.

10. The detonating cord transport package of claim 4 wherein said severing means comprises a portion of a nylon reinforced rubber hose that at least partially encompasses one of said detonating cord portions.

11. The detonating cord transport package of claim 5 wherein said severing means comprises a portion of a nylon reinforced rubber hose that at least partially encompasses one of said detonating cord portions.

12. The detonating cord transport package of claim 6 wherein said severing means comprises a portion of a nylon reinforced rubber hose that at least partially encompasses one of said detonating core portions.

13. A detonating cord transport package comprising a plurality of stacked sections, with each section comprising:

a. a detonating cord separator-support member having front and back face surfaces and edge surfaces;

b. detonating cord winding support means disposed linearly of said edge surfaces of said separator-support member;

c. a continuous length of detonating cord windingly disposed on said support means such that there are a plurality of severing locations where a second detonating cord portion is disposed in proximity with a first detonating cord portion; and d. severing means interposed between said first and second detonating cord portions at each of said severing locations, said continuous length of detonating cord being windingly disposed on said detonating cord winding support means and between adjacent detonating cord separator-support means such that said continuous length of detonating cord cannot be withdrawn from between adjacent detonating cord separator-support members of adjacent stacked sections when in their stacked positions, said front and back surfaces of said detonating cord separator-support member being generally planar, each of said detonator cord winding support member comprising surface means transverse to said generally planar front and back surfaces around which said continuous length of detonating cord is at least partially looped.

14. A detonating cord transport package comprising a plurality of stacked sections, with each section comprising:

a detonating cord separator-support member having front and back faces and side edges located in a given plane;

a plurality of spaced apart detonating cord winding support means disposed interiorly of said side edges of said separator-support member;

a continuous length of detonating cord windingly disposed on said plurality of winding support means such that there are a plurality of spaced apart severing locations where a second detonating cord portion is disposed in proximity with a first detonating cord portion; and severing means interposed between said first and second detonating cord portions at each of said severing locations; and, each of said detonating cord winding support members comprises surface means transverse to said plane of said side edges around which said continuous length of detonating cord is at least partially looped.

15. The detonating cord transport package of claim 14, wherein:

said continuous length of detonating cord is windingly disposed on said plurality of winding support means and on each of said detonating cord separator-support members such that said continuous length of detonating cord cannot be withdrawn from between adjacent detonating cord separator-support members of adjacent stacked sections when in their stacked positions.

16. The detonating cord transport package of claim 15 wherein:

said separator-support members each have a plurality of openings extending therethrough and communicating between said front and back faces thereof, said plurality of winding support means comprises a plurality of columnar winding support members that removably extend through said openings in said separator-support members, wherein each section comprises portions of said columnar winding support members.

17. The detonating cord transport package of claim 15 wherein:

said separator-support members each have a plurality of openings extending therethrough and communicating between said front and back faces thereof, each of said plurality of winding support means comprises a plurality of columnar winding support arrangements, wherein each of said winding support arrangements comprises a plurality of columnar members that removably extend through said openings in said separator-support members, and wherein each section comprises portions of said columnar members.

18. The detonating cord transport package of claim 14, wherein:

at each of said severing locations, said first and second detonating cord portions are maintained in proximity with each other, with said severing means interposed therebetween, only by the disposition of said detonating cord on said winding support means and said front and back surfaces of adjacent detonating cord separator-support means of adjacent stacked sections.

19. A detonating cord transport package comprising a plurality of stacked sections, with each section comprising:

a detonating cord separator-support member having front and back face surfaces and edge surfaces and a plurality of openings extending therethrough and communicating between said front and back face surfaces;

a plurality of detonating cord winding support means removably extending through said openings in said separator-support member;

a continuous length of detonating cord windingly disposed on said plurality of winding support means such that there are a plurality of spaced apart severing locations where a second detonating cord portion is disposed in proximity with a first detonating cord portion; and, severing means interposed between said first and second detonating cord portions at each of said severing locations;

said front and back surfaces of adjacent detonating separator-support members applying pressure at least to said first and second detonating cord portions located therebetween, at said severing locations.

20. A detonating cord transport package comprising a plurality of stacked sections, with each section comprising:

a detonating cord separator-support member having front and back face surfaces and edge surfaces;

a plurality of spaced apart detonating cord winding support means disposed on said separator-support member;

a continuous length of detonating cord windingly disposed on said plurality of winding support means such that there are a plurality of spaced apart severing locations where a second detonating cord portion is disposed in proximity with a first detonating cord portion; and, severing means interposed between said first and second detonating cord portions at each of said severing locations, at each of said severing locations, said first and second detonating cord portions are maintained in proximity with each other with said severing means interposed therebetween only by the disposition of said detonating cord on said winding support means and said front and back surfaces of said detonating cord separator-support members of adjacent stacked sections, said continuous length of detonating cord being windingly disposed on said plurality of detonating cord winding support means and between said adjacent detonating separator-support members such that said continuous length of detonating cord cannot be withdrawn from between adjacent detonating cord separator-support members of adjacent stacked sections when in their stacked positions, said separator-support members each having a plurality of openings extending therethrough and communicating between said front and back face surfaces, said plurality of detonating cord winding support means removably extending through said openings in said separator-support members, said front and back surfaces of adjacent detonating separator-support members applying pressure at least to said first and second detonating cord portions located therebetween, at said severing locations.

21. A detonating cord transport package comprising a plurality of stacked sections, with each section comprising:

a. a detonating cord separator-support member having front and back face surfaces and edge surfaces;

b. detonating cord winding support means disposed interiorly of said edge surfaces of said separator-support member;

c. a continuous length of detonating cord windingly disposed on said winding support means such that there are a plurality of severing locations where a second detonating cord portion is disposed in proximity with a first detonating cord portions; and, d. severing means interposed between said first and second detonating cord portions at each of said severing locations, each of said severing means comprising a longitudinal slit hose means located around one of said first and second detonating cord portions.

22. The detonating cord transport package of claim 14, wherein:

each of said severing means comprises a longitudinal slit hose means located around one of said first and second detonating cord portions.

23. A detonating cord transport package comprising a plurality of stacked sections, with each section comprising:

a detonating cord separator-support member having front and back face surfaces and edge surfaces;

a plurality of spaced apart detonating cord winding support means disposed on said separator-support member;

a continuous length of detonating cord windingly disposed on said plurality of winding support means such that there are a plurality of spaced apart severing locations where a second detonating cord portion is disposed in proximity with a first detonating cord portion; and, severing means interposed between said first and second detonating cord portions at each of said severing locations, at each of said severing locations, said first and second detonating cord portions are maintained in proximity with each other with said severing means interposed therebetween only by the disposition of said detonating cord on said winding support means and said front and back surfaces of said detonating cord separator-support members of adjacent stacked sections, each of said severing means comprising a longitudinal slit hose means located around one of said first and second detonating cord portions.

24. The detonating cord transport package of claim 19 wherein at each of said severing locations, said second detonating cord portion crosses said first detonating cord portion as seen from above.

25. The detonating cord transport package of claim 14, wherein at each of said severing locations, said second detonating cord portion crosses said first detonating cord portion as seen from above.

* * * * *